US005239711A

United States Patent [19]

Tafur

[11] Patent Number: 5,239,711

[45] Date of Patent: Aug. 31, 1993

[54] HEADREST FOR SHAMPOO BOWLS AND SINKS

[76] Inventor: Jose J. Tafur, 2122 Haven House, Spring, Tex. 77386

[21] Appl. No.: 742,392

[22] Filed: Aug. 8, 1991

[51] Int. Cl.[5] ..... A45D 44/10

[52] U.S. Cl. ..... 4/523; 4/519

[58] Field of Search ..... 4/515-523, 4/575.1, 579

[56] References Cited

U.S. PATENT DOCUMENTS

| | | | |
|---|---|---|---|
| 492,949 | 3/1893 | Treiber | 4/575.1 |
| 647,160 | 4/1900 | Silver | 4/579 |
| 732,249 | 6/1903 | Wolpert | 4/579 |
| 1,817,625 | 8/1931 | Holmes | 4/523 X |
| 4,546,504 | 10/1985 | Vars | 4/516 X |
| 4,956,881 | 9/1990 | Lindley et al. | 4/517 |

*Primary Examiner*—Charles E. Phillips
*Attorney, Agent, or Firm*—Kenneth A. Roddy

[57] ABSTRACT

A head support spans the entire width of a shampoo bowl or sink of the type having neck depression in the front wall and supports the head of a person during rinsing operations. The head support is a flexible elongate rectangular strip of open mesh netting of having a rectangular generally J-shaped clip releasably attached at each end by hook and loop type fasteners. A second rectangular generally J-shaped clip is secured to the opposed side walls of the shampoo bowl or sink and releasably receive and engage the curved portion of the clips at the ends of the netting. The clips on at the ends of the netting are adjustable such that the length of the strip between the end clips can be increased or decreased to span shampoo bowls of different widths and the slack or tension of the supporting span can be adjusted for supporting the head at various distances above the bottom wall of the shampoo bowl to provide a comfortable angle of the person's neck. The curved portions of the engaged clips extend longitudinally and are slidably engaged such that the portion of the strip spanning the distance between opposed side walls can be positioned at various distances relative to the front wall of the shampoo bowl to compensate for different neck lengths and head sizes.

17 Claims, 2 Drawing Sheets

HEADREST FOR SHAMPOO BOWLS AND SINKS

BACKGROUND OF THE INVENTION

1. Field of the Invention

This invention relates generally to toiletries, and more particularly to a headrest adapted to be attached to a shampoo bowl or sink for supporting the head of a person during various hair treatment procedures.

2. Brief Description of the Prior Art

Hair treatment processes, such as shampooing, dyeing, coloring, and applying permanent waves, are usually performed by the operator while the customer is seated in a chair. The customer leans his or her head back over a shampoo sink or bowl and the hair is carefully rinsed to wash out the chemicals. The customer must maintain this uncomfortable position for extended periods of time, for example ten minutes or more. During the permanent wave process, the customer must wear perm rods in the hair and the hair is rinsed during two periods of about five minutes each. During these periods, the neck of the customer rests in a depression in the front wall of the shampoo sink or bowl. These resulting pressure on the back of the neck can be extremely uncomfortable during these extended periods of time. It is particularly uncomfortable if the customer has perm rods in the neck area since these would be forced against the neck and scalp by the depression in the sink or bowl.

The operator will often support the head of the customer with one hand while trying to carry out the treatment with only one hand free, which makes the process difficult, inefficient, and time consuming.

There are several patents which disclose various head supporting devices but none of which have the particular advantages of the present invention.

Treiber, U.S. Pat. No. 492,949 discloses an attachment for bath tubs which may be used as a seat or head support. The device comprises a pair of semi-cylindrical slotted hooks which fit over the edges of the tub and to which a band of flexible material is attached. The ends of the band are drawn back and forth through the slots of the hooks to adjust the span of the band and prevent the hooks from marring the surface of the tub.

Holmes, U.S. Pat. No. 1,817,625 discloses a shampoo headrest for sinks having a U-shaped bracket with a pair of arms pivotally connected thereto and C-clamps at their outer ends. A flexible strap has rings at each end which are connected to the U-shaped bracket. This device is a complex metal frame structure and would not be suitable for use on present day shampoo bowls or sinks.

Grim, U.S. Pat. No. 4,352,216 discloses a rigid plastic headrest attachment for shampoo bowls which has an oval or circular frame with an integrally molded rigid open mesh panel and a hanger which fits onto the neck depression of the shampoo bowl and is connected into a slot on the plastic frame.

Porco, U.S. Pat. No. 4,922,558 discloses a headrest for shampoo bowls having a web support at the upper end of a pair of X-shaped legs and suction cups at the bottom ends of the legs.

Vars, U.S. Pat. No. 4,546,504 discloses a head support for a shampoo sink which has a rectangular flexible band of plastic material with apertures therethrough an holes at each end. A cord passes beneath the band and through the end holes and the ends of the cord are tied to Z-shaped hooks which engage the side walls of the sink. The length of the rectangular band is substantially less than the width of the sink measured between the side walls.

A commercially available head support for shampoo bowls is manufactured by Head Hammock of Polson, Mont. The Head Hammock device is quite similar to the Vars U.S. Pat. No. 4,546,504, except that it uses an oval-shaped net head support and has a pair of V-shaped webbing straps sewn to each end of the oval net which extend divergently outward and have one element of a hook-and-loop fabric fastener sewn to the outer ends of the webbing straps to releasably engage mating elements of the fasteners which are glued to the top surface of the sink. The length of the oval net is substantially less than the width of the sink measured between the side walls. The oval net also has a surrounding border of a different fabric material sewn thereon.

One of the major problems of the Vars and Head Hammock devices is that the size of the rectangular and oval-shaped head portions are much smaller than the width of the span between the side walls of the sink which makes them difficult to properly position them in the center of the span and to properly position the customer's head on the small head support portions. Both devices have the ends of the cords or straps fastened at the top surface of the shampoo bowl which subjects them to becoming accidentally unfastened due to the actions of the customer or the hairdresser. The customer's hair can also become entangled in the fasteners at the top surface of the shampoo bowls.

The wide webbing straps of the Head Hammock device converge at the ends of the head support portion in a V-shape and excessive splashing is caused by the exposed widths of webbing material at the sides of the head. These webbing straps are doubled over and sewn to the ends of the head support portion and during use, the increased thickness is disposed beneath the head of the customer which causes discomfort. The webbing material also gets wet during the rinsing operation and does not dry quickly. Harsh chemicals are also absorbed into the webbing material.

The present invention is distinguished over the prior art in general, and these patents in particular by a head support which spans the entire width of a shampoo bowl or sink of the type having neck depression in the front wall and supports the head of a person during rinsing operations. The head support is a flexible elongate rectangular strip of open mesh netting of having a rectangular generally J-shaped clip releasably attached at each end by hook and loop type fasteners. A second rectangular generally J-shaped clip is secured to the opposed side walls of the shampoo bowl or sink and releasably receive and engage the curved portion of the clips at the ends of the netting. The clips on at the ends of the netting are adjustable such that the length of the strip between the end clips can be increased or decreased to span shampoo bowls of different widths and the slack or tension of the supporting span can be adjusted for supporting the head at various distances above the bottom wall of the shampoo bowl to provide a comfortable angle of the person's neck. The curved portions of the engaged clips extend longitudinally and are slidably engaged such that the portion of the strip spanning the distance between opposed side walls can be positioned at various distances relative to the front wall of the shampoo bowl to compensate for different neck lengths and head sizes.

SUMMARY OF THE INVENTION

It is therefore an object of the present invention to provide a headrest for shampoo sinks and bowls which will comfortably support the head of a customer and relieve the pressure on the back of the neck of the customer.

It is another object of this invention to provide a headrest for shampoo sinks and bowls which will greatly reduce splashing during hair rinsing operations and allow drainage of rinse water.

Another object of this invention is to provide a headrest for shampoo sinks and bowls which is easily and quickly installed on and removed from existing shampoo sinks and bowls.

Another object of this invention is to provide a headrest for shampoo sinks and bowls which adjustable to span the width of existing shampoo sinks and bowls of various size.

Another object of this invention is to provide a headrest for shampoo sinks and bowls which comprises open net materials and will dry quickly and can be conveniently stored when not in use.

Another object of this invention is to provide a headrest for shampoo sinks and bowls which will allow the operator free use of both hands during hair treatment operations.

A further object of this invention is to provide a headrest for shampoo sinks and bowls which will make hair treatment operations more comfortable for the customer and more efficient and expedient for the operator.

A still further object of this invention is to provide a headrest for shampoo sinks and bowls which is simple in construction, economical to manufacture, and durable in use.

Other objects of the invention will become apparent from time to time throughout the specification and claims as hereinafter related.

The above noted objects and other objects of the invention are accomplished by a head support which spans the entire width of a shampoo bowl or sink of the type having neck depression in the front wall and supports the head of a person during rinsing operations. The head support is a flexible elongate rectangular strip of open mesh netting of having a rectangular generally J-shaped clip releasably attached at each end by hook and loop type fasteners. A second rectangular generally J-shaped clip is secured to the opposed side walls of the shampoo bowl or sink and releasably receive and engage the curved portion of the clips at the ends of the netting. The clips on at the ends of the netting are adjustable such that the length of the strip between the end clips can be increased or decreased to span shampoo bowls of different widths and the slack or tension of the supporting span can be adjusted for supporting the head at various distances above the bottom wall of the shampoo bowl to provide a comfortable angle of the person's neck. The curved portions of the engaged clips extend longitudinally and are slidably engaged such that the portion of the strip spanning the distance between opposed side walls can be positioned at various distances relative to the front wall of the shampoo bowl to compensate for different neck lengths and head sizes.

DESCRIPTION OF THE PREFERRED EMBODIMENT

Figure 1:
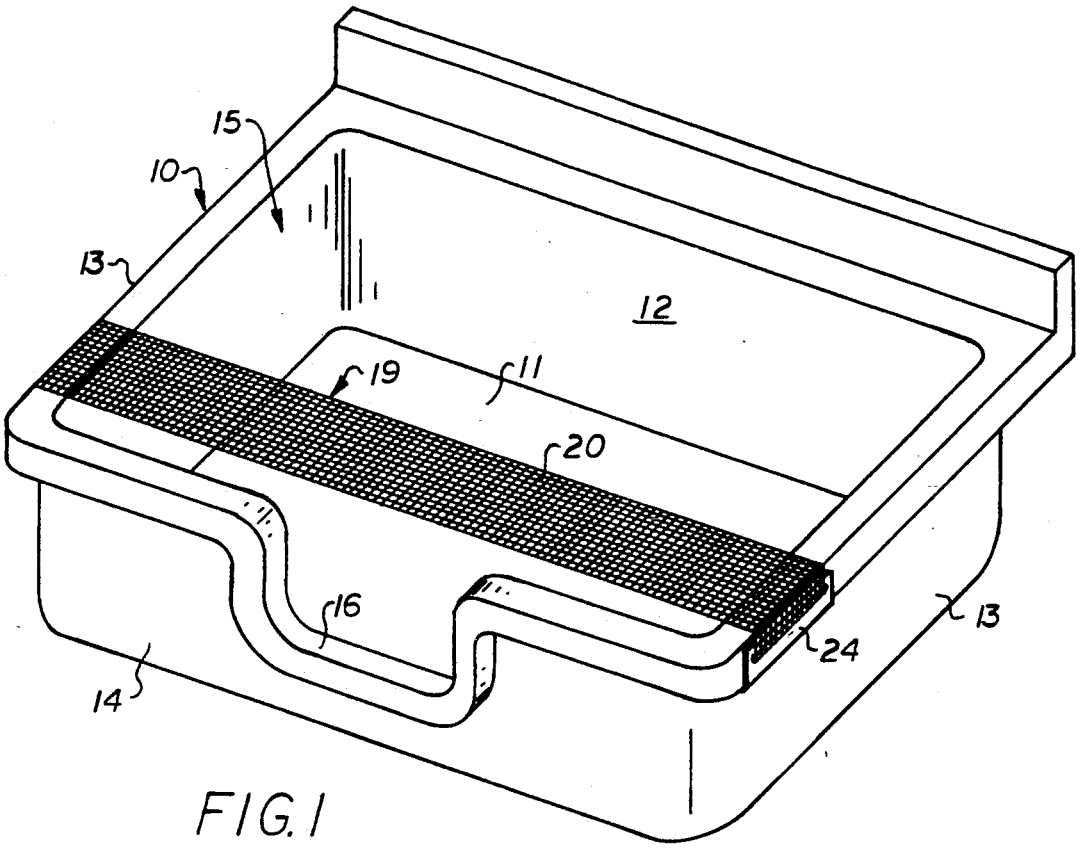
FIG. 1 is a perspective view of a preferred headrest in accordance with the present invention installed on a conventional shampoo bowl.

Referring to the drawings by numerals of reference, there is shown in FIG. 1, a conventional shampoo bowl or sink 10 having a bottom wall 11, a rear wall 12, opposed side walls 13, and a front wall 14 defining the bowl 15 of the sink. The front wall 14 has a neck depression 16. Normally, when undergoing a lengthy hair rinse operation, the neck of the customer rests in the depression 16 and the head is unsupported. This position can become quite painful during lengthy rinse periods and particularly when the hair near the neck region contains perm rods which contact the depression and press against the neck and scalp.

A headrest 19 in accordance with the present invention is shown attached to the shampoo bowl or sink 10 in FIG. 1. The headrest 19 is a flexible elongate rectangular strip of open mesh netting 20 which spans the entire width of the shampoo bowl from side to side. The headrest is formed of a length of plastic netting, the parallel longitudinal side edges of which are folded over and secured to form a hem 21 of double thickness. The hem 21 may be sewn or otherwise secured by other suitable means. The preferred headrest is approximately 4¼" wide and 28" in length.

The preferred netting material is formed of fiberglass material having an open mesh pattern wherein the openings are 1/16" square or larger to provide support and allow substantially full water drainage therethrough. It has been found that this pattern will also substantially reduce or eliminate splashing under the normal water pressure used in rinsing operations. This material will resist the detrimental effects of harsh chemicals and will not shrink.

Figure 2:
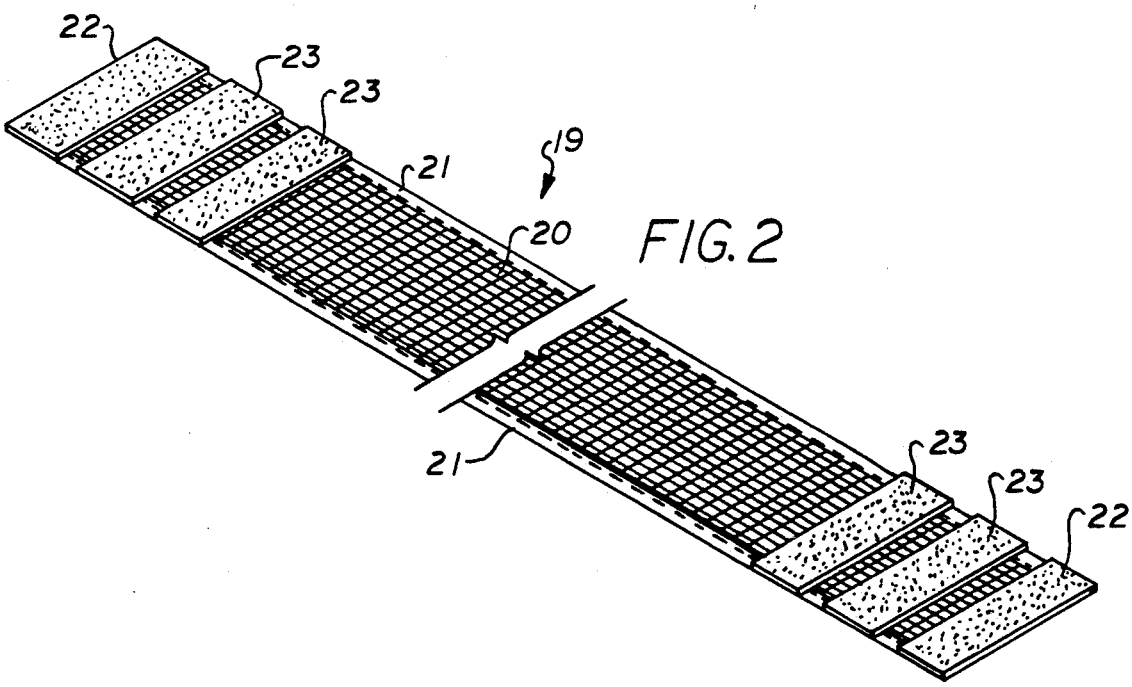
FIG. 2 is an isometric view of the netting strip of the headrest.

As best seen in FIG. 2, each end of the rectangular netting is provided with a strip 22 of one element of a hook and loop type fastener and a plurality of strips 23 of the mating element of the hook and loop type fastener spaced inwardly therefrom. The fastener strips 22, 23 are secured transversely across one surface of the netting 20 by sewing or other conventional means in longitudinally spaced relation.

Figure 3:
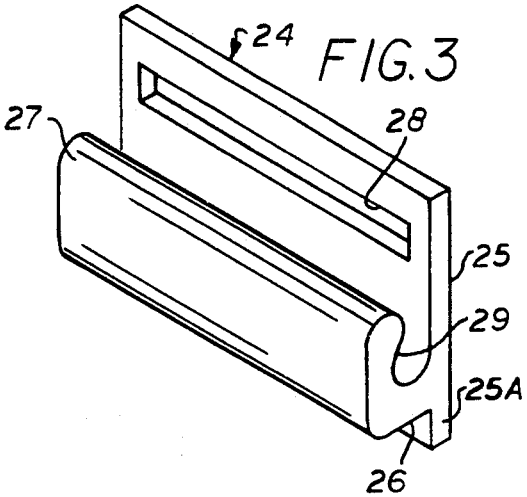
FIG. 3 is an isometric view of a clip member which is installed on the ends of the netting and side walls of the shampoo bowl.
Figure 4:
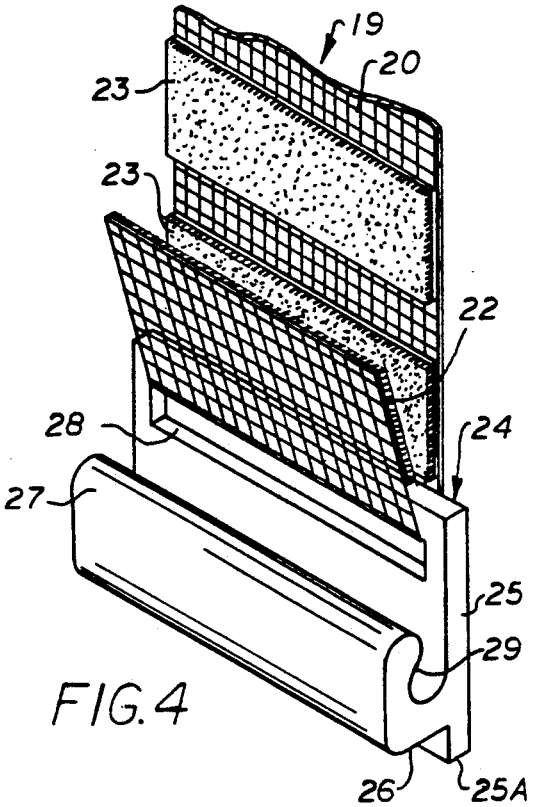
FIG. 4 is an isometric view of a clip member being installed on the end of the netting.
Figure 5:
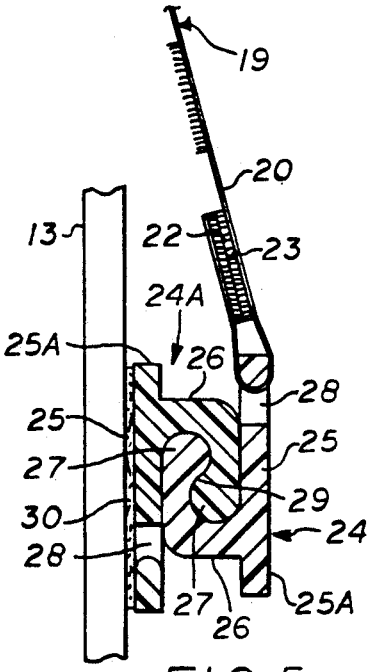
FIG. 5 is a cross sectional view of showing one clip member mounted on the side wall of the shampoo bowl and a clip member at the end of the netting connected thereon.

Referring now to FIGS. 3, 4, and 5, clip members 24 are used to releasably attach the headrest 19 to the shampoo bowl. Each clip member 24 is a generally rectangular member having a vertical portion 25 with a short horizontal portion 26 near one end which curves outwardly and then curves inwardly and upwardly to terminate in a rounded edge configuration 27. A. longitudinal slot 28 extends through vertical portion 25 near one end. When viewed transversely, the clip is a generally J-shaped configuration having a short S-shaped recurved portion 29 with a rounded edge 27 at the top of the recurved portion.

In some installations only one pair of clips 24 are required, and in other installations, a set of four identical clip members may be used to releasably attach the headrest to the shampoo bowl. The configuration of the clips 24 allow the recurved portion 29 of one clip to fit inside the recurved portion of another identical clip in inverted relation. The short extension 25A of the vertical portion 25 below the horizontal portion 26 serves as a gripping surface for handling the clips when connecting them together and attaching them to the side walls of the shampoo bowl.

As shown in FIG. 4, a clip member 24 is installed on each end of the rectangular netting 20 by passing the end of the netting through the slot 28 and looping it up to place the endmost fastener strip 22 adjacent one of the mating strips 23 and then pressing them together to engage the fasteners. The strip of netting 20 having the clips 24 installed can then be placed over the shampoo bowl.

In some installations, the clips 24 can be simply hooked onto the surrounding rim or depending lip of the shampoo bowl having such a lip, as shown in FIG. 1. In other installations, it may be desirable to secure a pair of mounting clips 24A to the outer surface of the side wall 13 of the shampoo bowl. This is accomplished by placing the strip of netting 20 having the clips 24 installed over the shampoo bowl and allowing the clips 24 to hang free similar to the position in FIG. 1 to determine the location of the clips 24A to be mounted on the side walls 13 of the shampoo bowl. To more precisely determine the location of the mounting clips 24A, a mounting clip 24A may be inverted and inserted into each of the clips 24 at the end of the netting 20 and held against the side wall 13 of the shampoo bowl while the location is marked.

Referring now to FIG. 5, once the location for the mounting clips 24A has been determined, a clip is secured to the side wall 13 of the shampoo bowl by means of double sided adhesive tape 30. The preferred adhesive material is water resistant.

Once the mounting clips 24A have been secured, the clips 24 at each end of the netting 20 are inserted into the clips 24A which have been attached to the side walls 13. The rounded mating surfaces 27 of the clips provide a secure connection while also compensate for variations in the angular orientation of the side wall between various shampoo bowl manufacturers.

Figure 6:
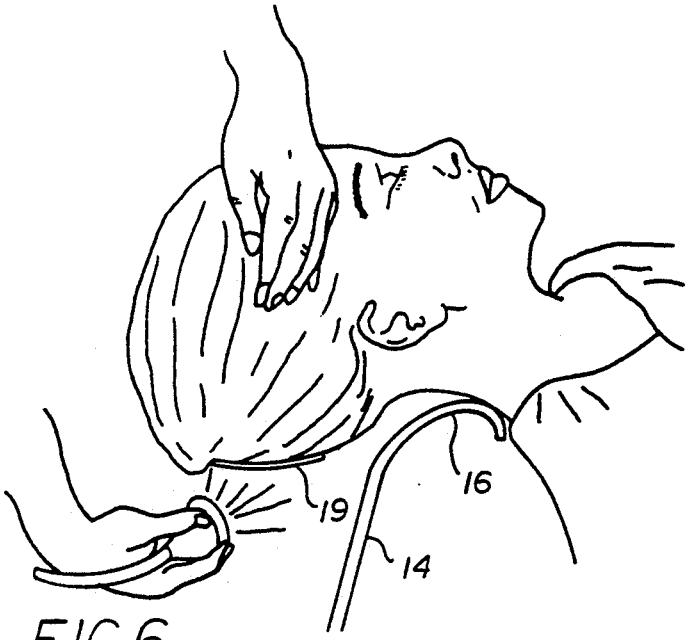
FIG. 6 is a pictorial view showing a customer's head supported on the headrest.

As seen in FIG. 6, after the headrest 19 has been installed, the customer's head can be supported above the bowl with the neck barely touching the neck depression 16 in the front wall 14 of the shampoo bowl. Thus, the weight of the customer's head is supported on the headrest 19 which eliminates the customer having to support the weight of the head by his or her neck muscles or the operator having to support the customer's head with one hand. This also leaves both hands of the operator free to carry out the lengthy rinsing processes. When the customer's head is thus supported, the operator has better access to the neck area than when the neck is supported in the neck depression and when the head is supported in the hand of the operator.

Because the headrest of the present invention spans the entire width of the bowl, the supported head of the customer can be turned from side to side to provide even greater access and more efficient rinsing in hard to reach areas.

Another feature of the present invention of major importance is the adjustment factor it provides. The plurality of fastener strips 22,23 at the end of the netting 20 allow the headrest 19 to span sink bowls of various widths. To adjust for variations in bowl widths, the fasteners 22 at either one end or both ends of the netting 20 be moved up or down to engage the next adjacent mating strip 23. Being able to move the end clips 24 longitudinally adjusts the length between the clips, and thus will also allow the operator to adjust the slack or tension of the netting spanning the bowl. By adjusting the slack or tension, the customer's head can be placed at various levels to provide a comfortable angle for the neck and eliminate contact of the perm rods with the neck depression.

The longitudinal length of the mating portions of the clips 24,24A allow the clips 24 at the end of the netting to be slid axially relative to the mounting clips 24A on the side wall 13 so that the netting 20 can be moved forward or backward relative to the neck depression 16 in the front wall 14 of the shampoo bowl. This feature allows the operator to adjustably position the headrest 19 according the neck length and head size of the customer.

For example, children have a shorter neck length and smaller head than adults, and some people have a large head and short neck and vise versa. By adjusting the position of the headrest horizontally and vertically relative to the neck depression and the level of the head above the bowl, the operator can find a comfortable position for nearly any customer.

Because the headrest is substantially all open mesh, and does not utilize fabric webbing or straps, there is virtually no splashing, and all the water will completely drain through the netting. After use, the headrest can be easily removed from the shampoo bowl and will dry very quickly. The head rest can be rolled into a compact configuration and stored when not in use. Once the mounting clips 24A have been installed on several bowls, the headrest can be easily and quickly moved from one shampoo bowl to another.

While this invention has been described fully and completely with special emphasis upon a preferred embodiment, it should be understood that within the scope of the appended claims the invention may be practiced otherwise than as specifically described herein.

I claim:

1. A head support for use on a shampoo bowl or sink of the type having a bottom wall, a pair of opposed side walls and a front wall with a neck depression therein, the head support comprising;

a flexible elongate rectangular strip of foraminous material of sufficient length to span the entire distance between the opposed side walls of the shampoo bowl or sink, a first pair of clip members each having a generally J-shaped cross section defined by a vertical portion with a short horizontal portion near one end which curves outwardly and then curves inwardly and upwardly to terminate in a rounded edge, one said clip member releasably attached to each end of said strip, and a second pair of said clip members adapted to be inverted and secured on the opposed side walls of the shampoo bowl or sink such that the curved portions of each said second pair of clip members releasably receive and engage the curved portions of each said first pair of clip members to releasably connect them together, whereby said strip of foraminous material is suspended above the bottom wall of the shampoo bowl or sink to span the entire distance between the opposed side walls for supporting the head of a person whose neck is received in the neck depression.

2. The head support according to claim 1 in which the length of said flexible elongate rectangular strip of foraminous material is about six times its width.

3. The head support according to claim 1 in which said flexible elongate rectangular strip of foraminous material is open mesh netting formed of water impervious material.

4. The head support according to claim 3 in which said flexible elongate rectangular strip has parallel longitudinal side edges each folded over and secured in overlapped relation to form a hem of double thickness.

5. The head support according to claim 3 in which said open mesh netting is of formed of plastic material.

6. The head support according to claim 5 in which said plastic material is fiberglass.

7. The head support according to claim 3 in which the openings in said open mesh netting are at least 1/16" square to allow water to freely pass therethrough.

8. The head support according to claim 1 in which said first pair of clip members at each end of said strip are releasably and adjustably connected on said strip and movable longitudinally thereon such that the length of said strip between said first pair of clip members can be increased or decreased, whereby said head support is adjustable to span shampoo bowls or sinks of various different widths and the slack or tension of the portion of said strip spanning the distance between opposed side walls can be adjusted for positioning the supported head at various distances above the bottom wall of the shampoo bowl or sink to provide a comfortable angle of the person's neck.

9. The head support according to claim 1 in which said first pair of clip members at each end of said strip are releasably and adjustably connected with said second pair of clip members on the opposed side walls of the shampoo bowl or sink such that the portion of said strip spanning the distance between opposed side walls can be positioned at various distances relative to the front wall of the shampoo bowl or sink to compensate for various different neck lengths and head sizes.

10. The head support according to claim 1 in which said first pair of clip members at each end of said strip are releasably and adjustably connected on said strip and movable longitudinally thereon such that the length of said strip between said first pair of clip members can be increased or decreased, whereby said head support is adjustable to span shampoo bowls or sinks of various different widths and the slack or tension of the portion of said strip spanning the distance between opposed side walls can be adjusted for positioning the supported head at various distances above the bottom wall of the shampoo bowl or sink to provide a comfortable angle of the person's neck, and said first pair of clip members at each end of said strip are releasably and adjustably connected with said second pair of clip members on the opposed side walls of the shampoo bowl or sink such that the portion of said strip spanning the distance between opposed side walls can be positioned at various distances relative to the front wall of the shampoo bowl or sink to compensate for various different neck lengths and head sizes.

11. The head support according to claim 1 in which each one of said first pair of said clip members had a longitudinal slot through said vertical portion, a longitudinal cavity adjacent said vertical portion, and a rounded longitudinal edge at one end of said cavity, each end of said strip being received through a said longitudinal slot and releasably attached to a said clip of said first pair of clip members, and said longitudinal cavity and said rounded longitudinal edge of each one of said first pair of said clip members adapted to be releasably connected with said second pair of clip members on the opposed side walls of the shampoo bowl or sink.

12. The head support according to claim 11 in which each end of said strip has a strip of one element of a hook and loop type fastener and at least one strip of the mating element of the hook and loop type fastener spaced inwardly therefrom, said fastener strips secured transversely across one surface of said strip in longitudinally spaced relation, and each end of said strip being received through said longitudinal slot whereby said one element will engage said mating element to releasably attach said clips to each end of said strip.

13. The head support according to claim 1 in which the curved portions of each said pair of clips extend longitudinally and said first pair of clips are slidably engaged in the curved portion of said second pair of clips and are slidably movable relative thereto along the longitudinal axis, whereby the portion of said strip spanning the distance between opposed side walls can be positioned at various distances relative to the front wall of the shampoo bowl or sink to compensate for various different neck lengths and head sizes.

14. The head support according to claim 1 in which each one of said first pair of said clip members had a longitudinal slot through said vertical portion, a longitudinal cavity adjacent said vertical portion, and a rounded longitudinal edge at one end of said cavity, each end of said strip being received through a said longitudinal slot of each one of said first pair of members and releasably attached thereto, and the vertical portion of each of said second pair of clip members adapted to be secured on the opposed side walls of the shampoo bowl or sink in inverted opposed relation to said first pair of clip members, and said longitudinal cavity of said second pair of clip members adapted to receive said rounded longitudinal edge of said first pair of clip members and said rounded longitudinal edge of each said clip member engaged with the other to releasably connect them together.

15. The head support according to claim 14 including adhesive means on one surface of said vertical portion of each of said second pair of clip members for securing each of said second pair of clip members to the opposed side walls of the shampoo bowl or sink.

16. A head support for use on a shampoo bowl or sink of the type having a bottom wall, a pair of opposed side walls and a front wall with a neck depression therein, the head support comprising;

a flexible elongate rectangular strip of foraminous material of sufficient length to span the entire distance between the opposed side walls of the shampoo bowl or sink, a strip of one element of a hook and loop type fastener at each end of said strip and at least one strip of the mating element of the hook and loop type fastener spaced inwardly from each said strip of one element, said fastener strips secured transversely across one surface of said strip in longitudinally spaced relation, and a first pair of generally rectangular clips each having a generally J-shaped transverse cross section, one releasably attached at each end of said strip by said hook and loop type fasteners, a second pair of generally rectangular clips each having a generally J-shaped transverse cross section identical to said first pair of clips and adapted to be secured on the opposed side walls of the shampoo bowl or sink, and the J-shaped portion of each of said second pair of clips adapted to releasably receive and engage the J-shaped portion of each of said first pair of clips to releasably connect them together.

17. The head support according to claim 16 in which said first pair of clips being releasably and adjustably connected on said strip and movable longitudinally thereon such that the length of said strip between said attachment means can be increased or decreased, whereby said head support is adjustable to span shampoo bowls or sinks of various different widths and the slack or tension of the portion of said strip spanning the distance between opposed side walls can be adjusted for positioning the supported head at various distances above the bottom wall of the shampoo bowl or sink to provide a comfortable angle of the person's neck, and the J-shaped portions of each said first and second pair of clips extend longitudinally and said first pair of clips are slidably engaged in the J-shaped portion of said second pair of clips and are slidably movable relative thereto along the longitudinal axis, whereby the portion of said strip spanning the distance between opposed side walls can be positioned at various distances relative to the front wall of the shampoo bowl or sink to compensate for various different neck lengths and head sizes.

* * * * *